US008847716B2

(12) United States Patent
Fonville

(10) Patent No.: US 8,847,716 B2
(45) Date of Patent: Sep. 30, 2014

(54) INTEGRATED INTERLOCK FEATURE FOR OVERMOLDED COIL AND BOBBIN

(71) Applicant: GM Global Technology Operations LLC, Detroit, MI (US)

(72) Inventor: Carl E. Fonville, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/770,391

(22) Filed: Feb. 19, 2013

(65) Prior Publication Data

US 2014/0232498 A1 Aug. 21, 2014

(51) Int. Cl.
*H01F 5/00* (2006.01)
*H01F 7/16* (2006.01)

(52) U.S. Cl.
CPC ..... *H01F 7/16* (2013.01)
USPC ..... 335/282; 336/96; 336/198; 264/272.19

(58) Field of Classification Search
CPC ..... H01F 5/02; H01F 27/022
USPC ..... 336/92, 96, 208, 198; 264/272.19; 335/282, 299
See application file for complete search history.

(56) References Cited

U.S. PATENT DOCUMENTS 6,012,700 A 1/2000 Johnson et al.
6,991,197 B2 * 1/2006 Cox et al. ..... 242/614.1

FOREIGN PATENT DOCUMENTS

JP 04093004 A * 3/1992 ..... H01F 7/06

* cited by examiner

*Primary Examiner* — Ramon Barrera
(74) *Attorney, Agent, or Firm* — Harness, Dickey & Pierce, P.L.C.

(57) ABSTRACT

An electromagnetic solenoid is provided with a bobbin having a generally cylindrical body and a pair of radially outwardly extending end flanges each disposed at opposite ends of the generally cylindrical body. The pair of end flanges each have an inner face facing one another and an outer face facing away from one another. The inner and outer faces of the pair of end flanges have a plurality of grooves formed in a surface thereof. The grooves provide for enhanced retention of an over-mold that seals a coil within the bobbin assembly.

16 Claims, 6 Drawing Sheets

INTEGRATED INTERLOCK FEATURE FOR OVERMOLDED COIL AND BOBBIN

FIELD

The present disclosure relates to electromagnetic solenoids, and more particularly, to a wire wrapped bobbin with an overmolded exterior for use in a solenoid.

BACKGROUND

This section provides background information related to the present disclosure which is not necessarily prior art.

Electromagnetic solenoid valves are commonly used in the automotive industry and many other industries for opening and closing valves and actuating various components. Road salt, water, dirt, and debris may enter a solenoid valve despite many efforts to properly seal the valve. Currently, solenoid valves utilize a wire wrapped around the bobbin to define a coil thereon which is then overmolded with an elastomeric material in order to attempt to prevent leakage. However, after numerous cycles where the solenoid is heated up and cooled down, leakage issues can develop between the over-mold and the bobbin so that debris can get into the coil and short-circuit the solenoid. Under thermal cycling, the over-mold expands earlier than the inner core and a gap of a few microns occurs. Repeated cycles create a ratcheting effect causing the gap to increase, thus circumventing the seals and creating multiple leak paths.

SUMMARY

This section provides a general summary of the disclosure, and is not a comprehensive disclosure of its full scope or all of its features.

According to the principles of present disclosure, a bobbin for use with an electro-magnetic solenoid is provided including a spool-type bobbin having a generally cylindrical body and a pair of radially outwardly extending end flanges each disposed at opposite ends of the generally cylindrical body. The pair of end flanges each have an interface facing one another and said pair of end flanges each have an outer face facing away from one another. The inner and outer faces of the pair of end flanges have a plurality of grooves formed in a surface thereof. When the bobbin is overmolded, the overmold is received in the grooves in the inner and outer faces of the end flanges of the bobbin in order to mechanically lock the over-mold to the bobbin in order to prevent any leakage from forming therebetween as the solenoid is subjected to thermal cycling.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
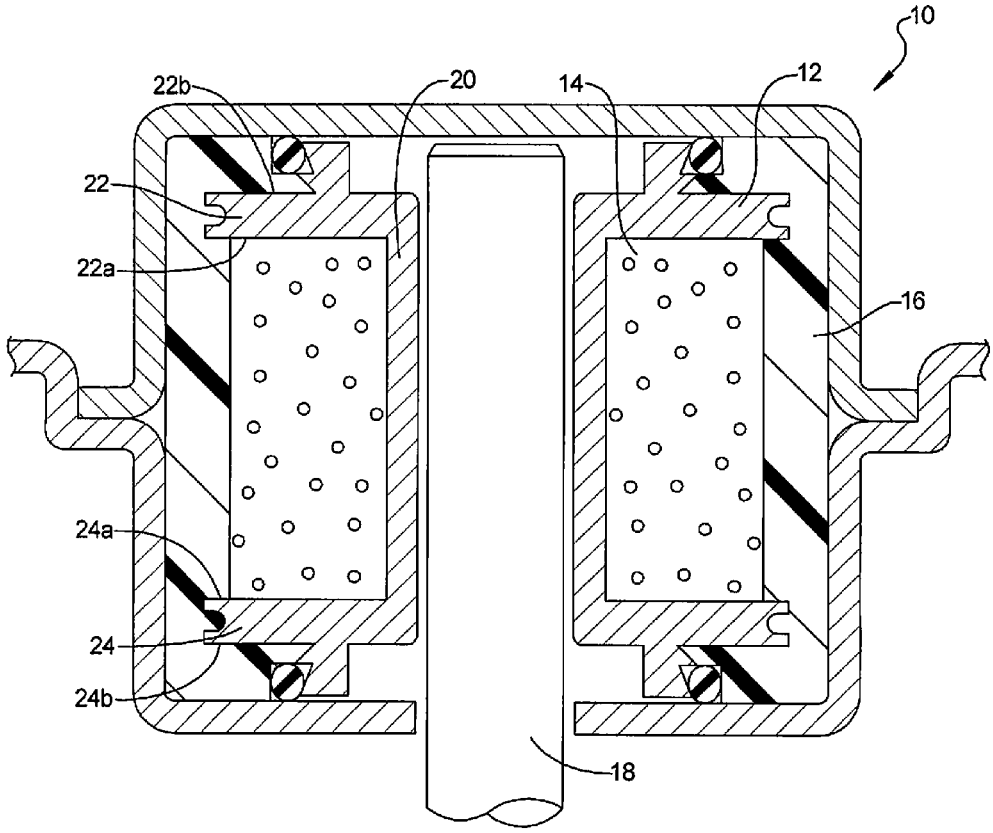
FIG. 1 is a cross-sectional view of a solenoid, according to the principles of present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
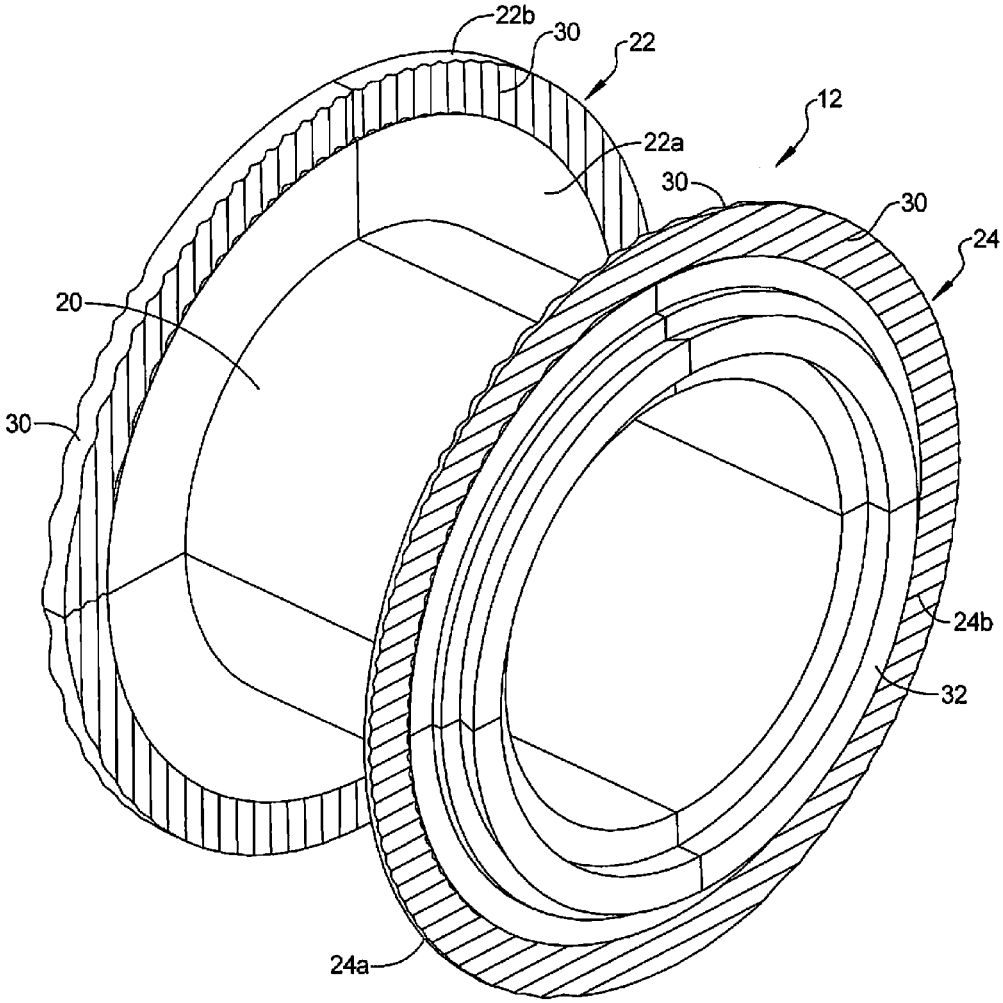
FIG. 2 is a perspective view of a bobbin, according to the principles of the present disclosure.

With reference to FIG. 1, a solenoid 10 is shown including a bobbin 12 having a coil 14 wrapped around the bobbin 12 and an over-mold 16 overmolded over the bobbin 12 and coil 14. A plunger 18 is received in the center of the bobbin 12, wherein supplying a current to the coil 14 creates an electromagnetic field that causes the plunger 18 to move axially for opening or closing a valve, or otherwise actuating another device. The bobbin 12 includes a cylindrical body 20 and a pair of end flanges 22, 24 which each include an inner face 22*a*, 24*a* and an outer face 22*b*, 24*b*. As best shown in FIG. 2, the inner and outer faces 22*a*, 22*b*, 24*a*, 24*b* of the pair of end flanges 22, 24, respectively, are provided with a plurality of grooves 30 formed in a surface thereof. The over-mold 16 is received within the grooves 30 that mechanically lock with the over-mold 16 to prevent separation of the over-mold 16 from the end flanges 22, 24 due to thermal expansion when the solenoid 10 is thermally cycled.

Figure 5:
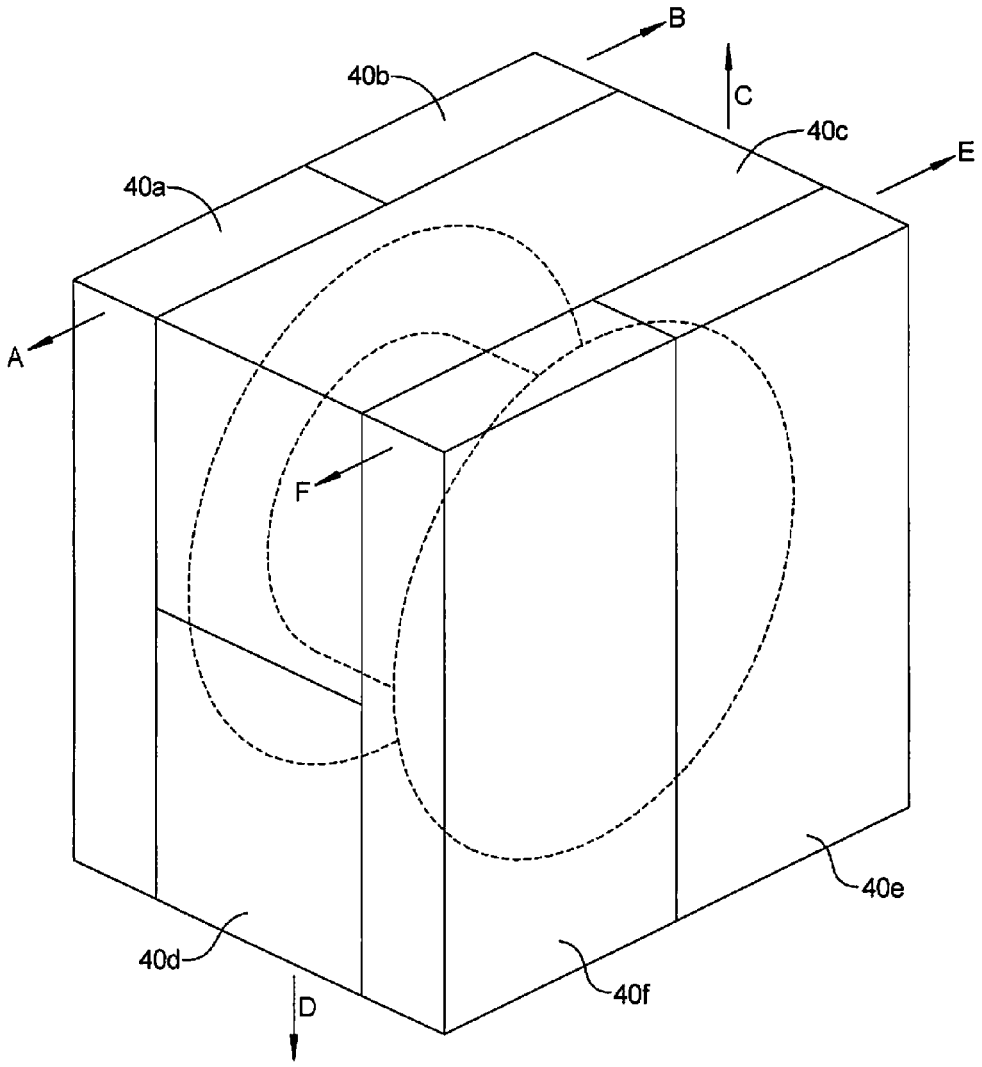
FIG. 5 is a schematic diagram of a molding device for molding the bobbin of FIG. 2.

The grooves 30 can be formed in the flanges 22, 24 of the bobbin 12 during the molding of the bobbin 12. As would be understood by one having ordinary skill in the art, the bobbin 12 can be made of plastic and can be molded in a mold cavity having several exterior cavity forming portions 40*a*-40*f*, as shown in FIG. 5, are moved to an engaged position to define a mold cavity in the shape of the bobbin 12, as illustrated in FIG. 2. When the mold components 40*a*-40*f* are removed from the molded part, each component 40*a*-40*f* has to be pulled in one direction A-F. Therefore, the grooves 30 formed on the flanges 22, 24 must align with the pull direction of the corresponding mold components 40*a*-40*f*. With the bobbin as illustrated in FIG. 2, the flanges 22, 24 can be provided with grooves 30 that extend in one direction on one face, and in a perpendicular direction on its opposite face. With this configuration, the different direction grooves 30 on opposite faces work together to mechanically lock the over-mold 16 to prevent separation of the over-mold 10 from the flange 22, 24 during thermal cycling.

Figure 3:
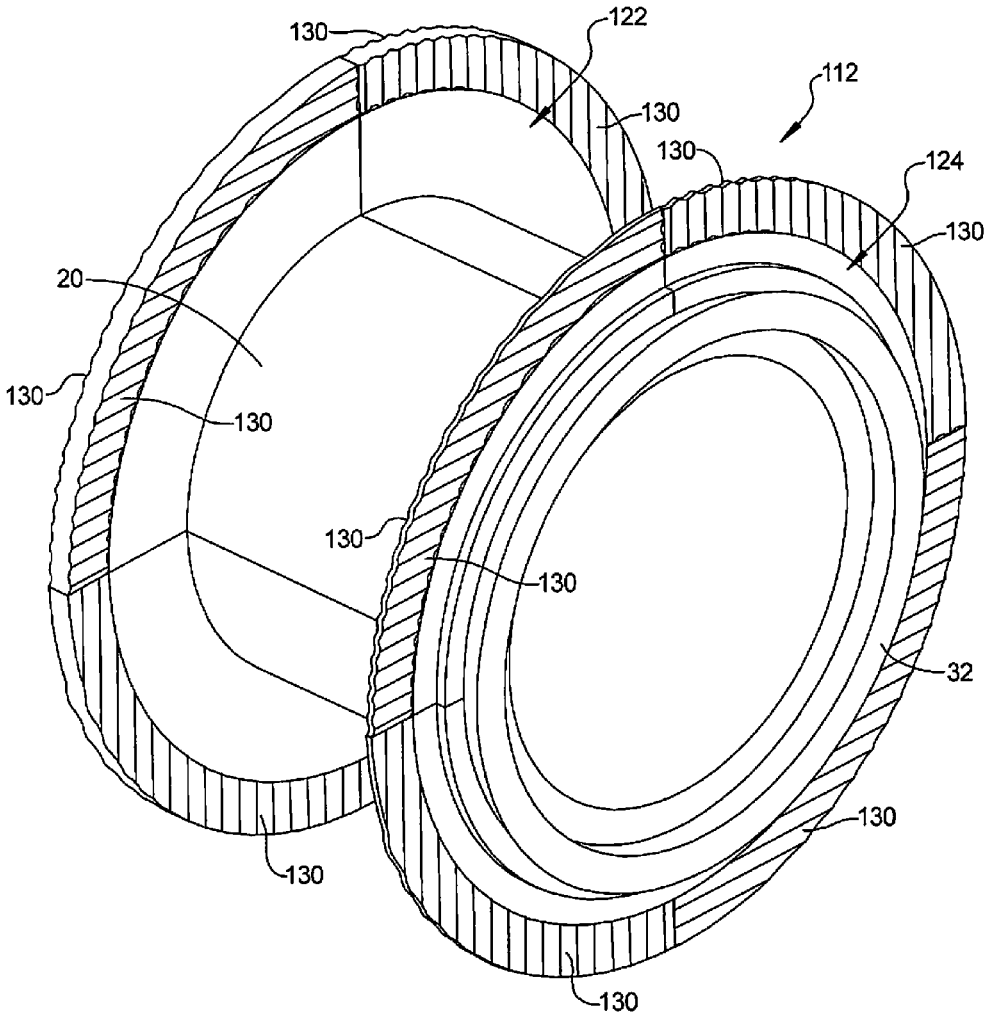
FIG. 3 is a perspective view of an alternative bobbin, according to the principles of present disclosure.
Figure 6:
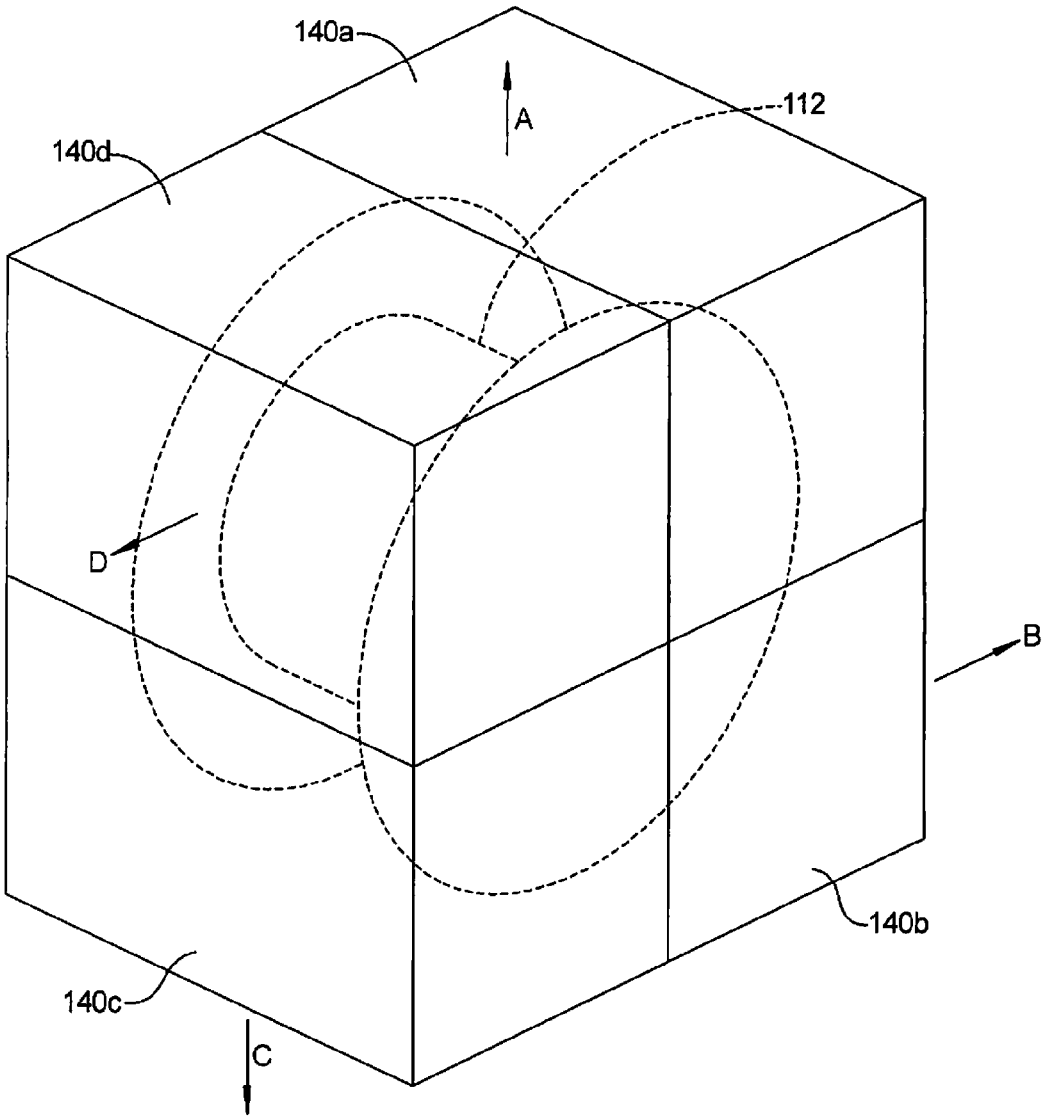
FIG. 6 is a schematic diagram of a molding device for molding the bobbin of FIG. 3.

As an alternative embodiment as shown in FIG. 3, the end flanges 122, 124 are divided into four quadrants with the mold components 140*a*-140*d*, as shown in FIG. 6, each corresponding to a quadrant of the flanges 122, 124 wherein the mold components 140*a*-140*d* can be pulled in a direction A-D aligned with the grooves 30. Accordingly, each quadrant of the flanges 122, 124 are provided with grooves 130 that are generally perpendicular to the grooves in an adjacent quadrant of that face. These perpendicular grooves on adjacent quadrants provide a locking function to prevent separation of the over-mold 16 due to thermal expansion.

Figure 4:
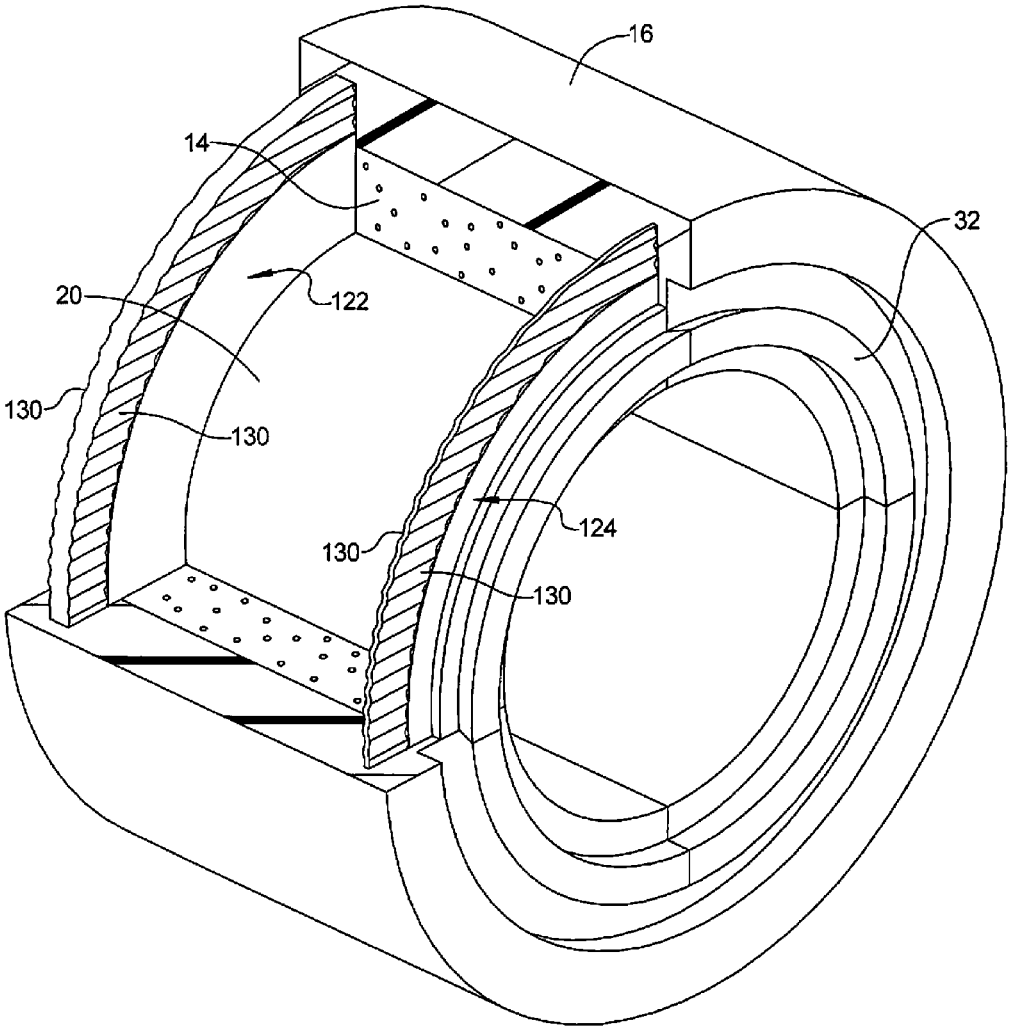
FIG. 4 is a partially cut-away perspective view of an overmolded bobbin and coil assembly, according to the principles of the present disclosure.

FIG. 4 shows a partially cut-away perspective view of an over-mold 16 on the bobbin 112 and coil 14 according to the principles of the present disclosure.

It is noted that the bobbin includes annular dovetail grooves 32 on opposite sides of the bobbin 12, 112. In the solenoid assembly as shown in FIG. 1, a pair of O-rings are disposed between the dovetail grooves 32 and the housing. The dovetail grooves 32 dictate that the mold components 40*a*-40*f*, 140*a*-140*d* be pulled in a radial direction relative to an axial center of the bobbin 12, 112. The orientation of the grooves 30, 130 allow for the pulling of the mold components 40*a*-*f*, 40*a*-*d* in the one direction as necessary. Accordingly, the bobbin 12, 112, according to the principles of present disclosure, result in an over-mold bobbin 12 and coil assembly that has an appearance that is the same as prior over-molded bobbin and coil assemblies as well as performing the same function thereof. However, the improved retention strength of the grooves 30, 130 provides an overmolded bobbin and coil assembly that does not experience separation and leakage due to thermal cycling.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electromagnetic solenoid, comprising:

a bobbin having a generally cylindrical body and a pair of radially outwardly extending end flanges each disposed at opposite ends of the generally cylindrical body, said pair of end flanges each having an inner face facing one another and said pair of end flanges each having an outer face facing away from one another, said inner and outer faces of said pair of end flanges having a plurality of grooves formed in a surface thereof;

a coil received around said generally cylindrical body of said bobbin between said pair of radially outwardly extending end flanges;

an over-mold formed over said bobbin and said coil, said over-mold being received in said grooves in said inner and outer faces of said end flanges of said bobbin; and a plunger received in said bobbin.

2. The electromagnetic solenoid according to claim 1, wherein said grooves in said surface of said inner face of said pair of end flanges are generally perpendicular to said grooves in said surface of said outer face of a corresponding one of said pair of end flanges.

3. The electromagnetic solenoid according to claim 2, wherein said bobbin includes a pair of annular dovetail grooves on opposite sides of said bobbin.

4. The electromagnetic solenoid according to claim 1, wherein inner and outer faces of said pair of end flanges are separated into four quadrants and said grooves in each quadrant are generally perpendicular to said grooves in an adjacent quadrant of that face.

5. The electromagnetic solenoid according to claim 4, wherein said bobbin includes a pair of annular dovetail grooves on opposite sides of said bobbin.

6. The electromagnetic solenoid according to claim 1, wherein said bobbin includes a pair of annular dovetail grooves on opposite sides of said bobbin.

7. The electromagnetic solenoid according to claim 6, further comprising a housing for receiving said bobbin and a pair of O-rings disposed between said dovetail grooves and said housing.

8. An overmolded bobbin and coil assembly for a solenoid, comprising:

a bobbin having a generally cylindrical body and a pair of radially outwardly extending end flanges each disposed at opposite ends of the generally cylindrical body, said pair of end flanges each having an inner face facing one another and said pair of end flanges each having an outer face facing away from one another, said inner and outer faces of said pair of end flanges having a plurality of grooves formed in a surface thereof;

a coil received around said generally cylindrical body of said bobbin between said pair of radially outwardly extending end flanges; and an over-mold formed over said bobbin and said coil, said over-mold being received in said grooves in said inner and outer faces of said end flanges of said bobbin.

9. The overmolded bobbin and coil assembly according to claim 8, wherein said grooves in said surface of said inner face of said pair of end flanges are generally perpendicular to said grooves in said surface of said outer face of a corresponding one of said pair of end flanges.

10. The overmolded bobbin and coil assembly according to claim 9, wherein said bobbin includes a pair of annular dovetail grooves on opposite sides of said bobbin.

11. The overmolded bobbin and coil assembly according to claim 8, wherein inner and outer faces of said pair of end flanges are separated into four quadrants and said grooves in each quadrant are generally perpendicular to said grooves in an adjacent quadrant of that face.

12. The overmolded bobbin and coil assembly according to claim 11, wherein said bobbin includes a pair of annular dovetail grooves on opposite sides of said bobbin.

13. The overmolded bobbin and coil assembly according to claim 8, wherein said bobbin includes a pair of annular dovetail grooves on opposite sides of said bobbin.

14. A bobbin for use with an electro-magnetic solenoid, comprising:

a spool-type bobbin having a generally cylindrical body and a pair of radially outwardly extending end flanges each disposed at opposite ends of the generally cylindrical body, said pair of end flanges each having an inner face facing one another and said pair of end flanges each having an outer face facing away from one another, said inner and outer faces of said pair of end flanges having a plurality of grooves formed in a surface thereof, wherein said grooves in said surface of said inner face of said pair of end flanges are generally perpendicular to said grooves in said surface of said outer face of a corresponding one of said pair of end flanges, wherein said bobbin includes a pair of annular dovetail grooves on opposite sides of said bobbin.

15. A bobbin for use with an electro-magnetic solenoid, comprising:

a spool-type bobbin having a generally cylindrical body and a pair of radially outwardly extending end flanges each disposed at opposite ends of the generally cylindrical body, said pair of end flanges each having an inner face facing one another and said pair of end flanges each having an outer face facing away from one another, said inner and outer faces of said pair of end flanges having a plurality of grooves formed in a surface thereof, wherein inner and outer faces of said pair of end flanges are separated into four quadrants and said grooves in each quadrant are generally perpendicular to said grooves in an adjacent quadrant of that face.

16. The bobbin according to claim 15, wherein said bobbin includes a pair of annular dovetail grooves on opposite sides of said bobbin.

* * * * *